US008833617B1

(12) United States Patent
Compton et al.

(10) Patent No.: US 8,833,617 B1
(45) Date of Patent: Sep. 16, 2014

(54) SEALED FLUID CONTAINER

(71) Applicants: Mark A. P. Compton, Lewisporte (CA); Gene Compton, Lewisporte (CA)

(72) Inventors: Mark A. P. Compton, Lewisporte (CA); Gene Compton, Lewisporte (CA)

( * ) Notice: Subject to any disclaimer, the term of this patent is extended or adjusted under 35 U.S.C. 154(b) by 0 days.

(21) Appl. No.: 13/798,769

(22) Filed: Mar. 13, 2013

(51) Int. Cl.
*B65D 47/00* (2006.01)
*B65D 47/06* (2006.01)

(52) U.S. Cl.
CPC ..... *B65D 47/065* (2013.01)
USPC ..... 222/534; 222/538; 222/536; 222/537; 222/530; 222/475; 222/468; 222/465.1; 222/481.5; 222/153.14; 222/483

(58) Field of Classification Search
CPC .. B65D 21/062; B65D 21/066; B65D 47/065; B65D 47/066; B65D 2251/1058; B65D 35/56; B65D 45/025; B65D 47/2006; B67D 7/42; B67D 7/005; B67B 7/28; B67C 11/04
USPC ..... 222/530, 475, 468, 465.1, 481.5, 222/153.14, 483–487, 534, 526, 538, 533, 222/536, 537
See application file for complete search history.

(56) References Cited

U.S. PATENT DOCUMENTS

| | | | | | |
|---|---|---|---|---|---|
| 215,771 | A | * | 5/1879 | Pierce | 222/183 |
| 245,041 | A | * | 8/1881 | Wood | 222/487 |
| 385,328 | A | * | 6/1888 | Straffin et al. | 222/487 |
| 446,809 | A | * | 2/1891 | Bonbrake | 222/323 |
| 470,838 | A | * | 3/1892 | Hart | 222/534 |
| 473,325 | A | * | 4/1892 | Merrill | 222/512 |
| 515,552 | A | * | 2/1894 | Phelps | 222/534 |
| 519,534 | A | * | 5/1894 | James | 222/534 |
| 521,113 | A | * | 6/1894 | Hart | 222/536 |
| 596,244 | A | * | 12/1897 | Lied | 222/487 |
| 1,056,855 | A | * | 3/1913 | Tamagno | 222/534 |
| 1,109,557 | A | * | 9/1914 | Tamagno | 222/498 |
| 1,259,057 | A | * | 3/1918 | Vick | 222/83 |
| 1,266,396 | A | * | 5/1918 | Brown | 222/473 |
| 1,343,782 | A | * | 6/1920 | Kerr | 222/85 |
| 1,494,043 | A | * | 5/1924 | Vogt | 222/484 |
| 1,514,944 | A | * | 11/1924 | Wiswell | 222/536 |
| 1,525,032 | A | * | 2/1925 | Grady | 222/484 |
| 1,537,399 | A | * | 5/1925 | Wiswell | 222/536 |
| 1,566,716 | A | * | 12/1925 | Wiswell | 222/536 |
| 1,617,992 | A | * | 2/1927 | Drake | 222/466 |
| 1,913,895 | A | * | 6/1933 | Paull | 222/487 |
| 2,021,411 | A | * | 11/1935 | Garrison | 222/402.16 |
| 2,038,349 | A | * | 4/1936 | Diesbourg | 222/153.06 |
| 2,065,785 | A | * | 12/1936 | Anschicks | 222/469 |
| 2,086,219 | A | * | 7/1937 | Geyser | 222/487 |
| 2,516,728 | A | * | 7/1950 | Smith | 222/108 |
| 2,630,247 | A | * | 3/1953 | Rafferty | 222/159 |
| 2,668,642 | A | * | 2/1954 | Johannesen | 222/484 |
| 2,705,580 | A | * | 4/1955 | Mack | 222/475 |
| 2,752,200 | A | * | 6/1956 | Santarelli | 239/153 |
| 2,786,606 | A | * | 3/1957 | Dushek et al. | 222/156 |

(Continued)

*Primary Examiner* — Kevin P Shaver
*Assistant Examiner* — Michael J Melaragno
(74) *Attorney, Agent, or Firm* — Robert C. Montgomery; Montgomery Patent & Design

(57) ABSTRACT

A fuel container includes sealed vessel having a pivoting spout assembly and fill nozzle assembly and a locking assembly. The container provides storage and dispensing of fuels without a user having to manually remove any caps. The spout assembly pivots closed and automatically seals when not in use. An air vent is built into the locking assembly to allow air to enter the vessel only during filling or dispensing, thereby effectively containing fumes within.

20 Claims, 5 Drawing Sheets

(56) References Cited

U.S. PATENT DOCUMENTS

| | | | | | |
|---|---|---|---|---|---|
| 2,998,162 | A | * | 8/1961 | Varnell | 222/54 |
| 3,154,219 | A | * | 10/1964 | Dean et al. | 222/129 |
| 3,171,573 | A | * | 3/1965 | Berney | 222/183 |
| 3,251,516 | A | * | 5/1966 | Thomas | 222/536 |
| 3,265,256 | A | * | 8/1966 | Chaber et al. | 222/534 |
| 3,318,494 | A | * | 5/1967 | Porter et al. | 222/534 |
| RE26,318 | E | * | 12/1967 | Wilson | 222/512 |
| 3,502,248 | A | * | 3/1970 | Newby et al. | 222/534 |
| 3,729,122 | A | * | 4/1973 | Flider | 222/469 |
| 3,739,938 | A | * | 6/1973 | Paz | 220/715 |
| 3,786,964 | A | * | 1/1974 | Landen | 222/153.14 |
| 4,015,756 | A | * | 4/1977 | Beck | 222/534 |
| 4,125,207 | A | * | 11/1978 | Ernst et al. | 222/130 |
| 4,650,100 | A | * | 3/1987 | Echazabal, Jr. | 222/475 |
| 4,746,036 | A | * | 5/1988 | Messner | 222/484 |
| 4,811,870 | A | * | 3/1989 | Bianco | 222/461 |
| 4,856,664 | A | * | 8/1989 | Gillispie et al. | 222/572 |
| 4,960,207 | A | * | 10/1990 | Tabler et al. | 206/507 |
| 5,277,343 | A | * | 1/1994 | Parsonage | 222/484 |
| 5,400,928 | A | * | 3/1995 | Resnick | 222/530 |
| 5,477,980 | A | * | 12/1995 | Chaffin | 220/715 |
| 5,524,799 | A | * | 6/1996 | Skillin | 222/534 |
| 5,564,608 | A | * | 10/1996 | Cooper | 222/470 |
| D376,540 | S | * | 12/1996 | Boumil | D23/211.2 |
| 5,671,868 | A | * | 9/1997 | Herr | 222/1 |
| 5,850,949 | A | * | 12/1998 | Koerbel et al. | 222/475 |
| 5,924,608 | A | * | 7/1999 | Chiu | 222/538 |
| 6,029,864 | A | * | 2/2000 | Nilsson et al. | 222/466 |
| 7,048,150 | B2 | * | 5/2006 | Barnett et al. | 222/143 |
| 7,513,394 | B2 | * | 4/2009 | Bone | 222/481.5 |
| 7,802,704 | B2 | * | 9/2010 | Hatch et al. | 222/534 |
| 8,091,744 | B2 | * | 1/2012 | Zwahlen | 222/534 |
| 8,616,419 | B2 | * | 12/2013 | Slack | 222/534 |
| 8,662,359 | B1 | * | 3/2014 | Hickey | 222/484 |
| 2005/0150916 | A1 | * | 7/2005 | De Laforcade | 222/534 |
| 2008/0302754 | A1 | * | 12/2008 | Lewin | 215/229 |
| 2010/0072230 | A1 | | 3/2010 | Hatch | |
| 2013/0068800 | A1 | * | 3/2013 | Ouderkirk | 222/534 |

* cited by examiner

SEALED FLUID CONTAINER

RELATED APPLICATIONS

Not applicable.

FIELD OF THE INVENTION

The present invention relates generally to fluid holding containers, and in particular, to a spring-sealed fluid holding container.

BACKGROUND OF THE INVENTION

Portable gas cans are frequently used to refuel motor vehicles and transfer gasoline to small power equipment such as lawn mowers and chainsaws. Such containers have been in use for multiple generations and provide for generally safe usage. While no one will doubt the safety and convenience of a portable gas container, this does not mean that they are not without their disadvantages, such as the problems encountered when initially filling the can from a gasoline pump. The user is typically required to remove the pour spout, find a place to store it, and perhaps even get gasoline on their hands while handling the spout. Another instance is when the extended spout causes the can to get knocked over where gasoline can spill out. While caps and covers are available to help prevent such occurrences, their usage is not failsafe and they are often not even used in the first place due to the inconvenience involved.

Accordingly, there exists a need for a container to address the problems and disadvantages as described above.

SUMMARY OF THE INVENTION

The inventor has recognized the aforementioned inherent problems and lack in the art and observed that there is a need for a fluid container that can easily and quickly be filled with and dispense a fluid without accidental spillage or contact with the fluid. The development of the present invention, which will be described in greater detail herein, substantially departs from conventional solutions to provide a sealed fluid container and in doing so fulfills this need.

In one (1) embodiment, the disclosed sealed fluid container can include a closed vessel defining an internal volume, a spout assembly pivotably connected to the vessel and in fluid communication with the internal volume, a fill nozzle assembly pivotably connected to the vessel and in fluid communication with the internal volume, and a locking assembly rotatably connected to the vessel and in fluid communication with the internal volume, wherein the spout assembly and the fill nozzle assembly are movable between a stowed position and a deployed position, and wherein the locking assembly releasably secures the spout assembly and the fill nozzle assembly in the stowed position.

In another embodiment, the disclosed sealed fluid container can include a closed vessel including a walled rectangular body defining an internal volume, a spout storage slot disposed on an upper end of the body, a fill nozzle storage slot disposed on the upper end of the body, a spout valve disposed in the body, the spout valve including a pair of opposing spout pivot enclosure receivers and a pair of spout valve apertures, each spout valve aperture being disposed within a corresponding spout pivot enclosure receiver, and a fill nozzle valve disposed in the body, the fill nozzle including a pair of opposing nozzle pivot enclosure receivers and a pair of nozzle valve apertures, each nozzle valve aperture being disposed within a corresponding nozzle pivot enclosure receiver; a spout assembly movable between a stowed position within the spout storage slot and a deployed position and in fluid communication with the internal volume, the spout assembly including a tubular spout having an open end, a spout pivot enclosure disposed at an end of the spout opposite the open end and being pivotably received between the pair of spout pivot enclosure receivers, a pair of spout pivot seals disposed on opposing side surfaces of the spout pivot enclosure, and a pair of spout apertures, each of the spout apertures being disposed through a corresponding side surface of the pivot enclosure and being alignable with the spout valve apertures when the spout assembly is in the deployed position; a fill nozzle assembly movable between a stowed position within the fill nozzle storage slot and a deployed position and in fluid communication with the internal volume, the fill nozzle assembly including a tubular fill nozzle having an open end, a nozzle pivot enclosure disposed at an end of the fill nozzle opposite the open end and being pivotably received between the pair of nozzle pivot enclosure receivers, a pair of nozzle pivot seals disposed on opposing side surfaces of the nozzle pivot enclosure, and a pair of fill nozzle apertures, each fill nozzle aperture being disposed through a corresponding side surface of the nozzle pivot enclosure and being alignable with the nozzle valve apertures when the fill nozzle assembly is in the deployed position; and a locking assembly rotatably connected to the vessel and in fluid communication with the internal volume, the locking assembly releasably secures the spout assembly and the fill nozzle assembly in the stowed position.

Furthermore, the described features and advantages of the disclosed sealed fluid container can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
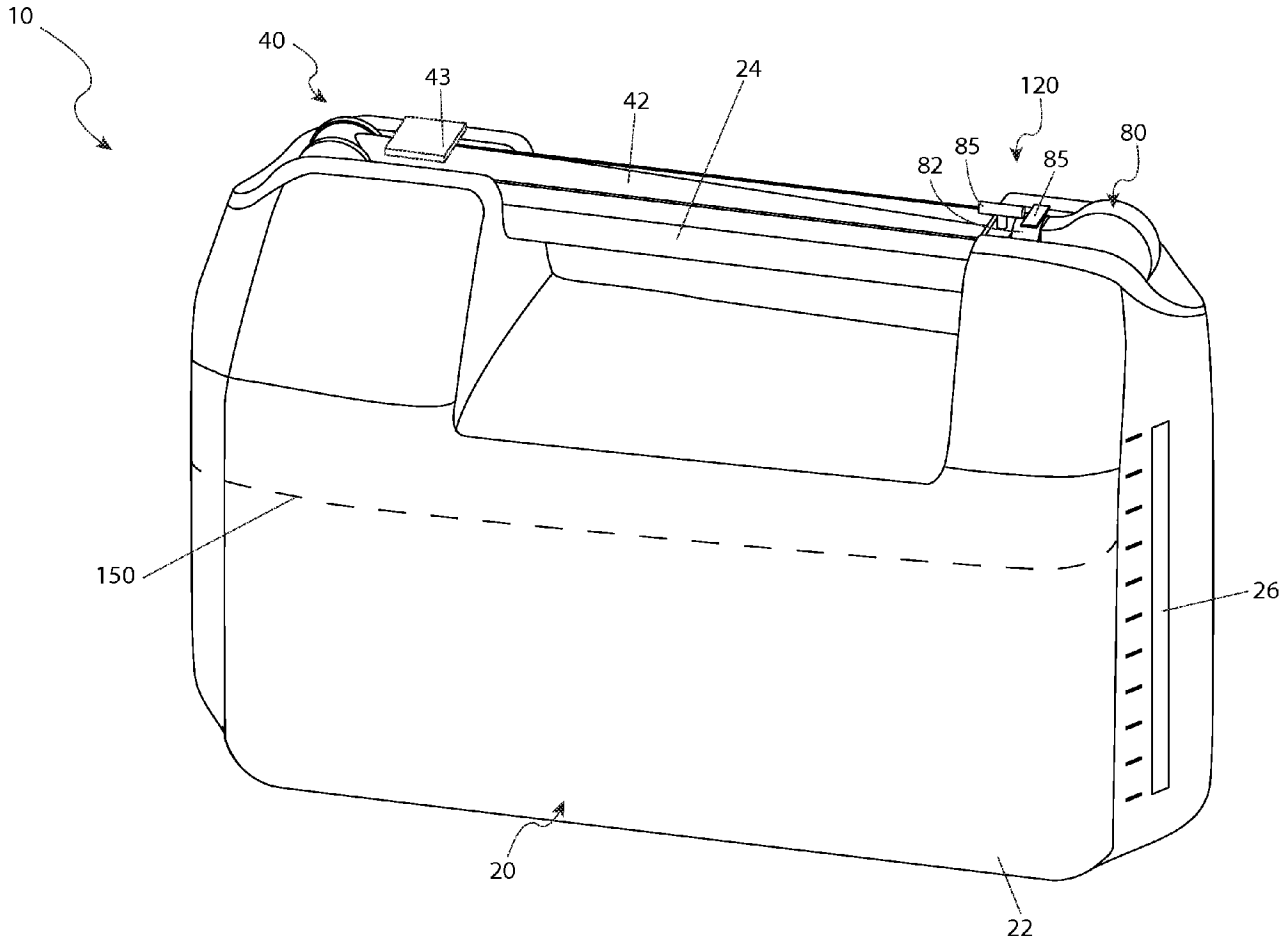
FIG. 1 is a side perspective view of a sealed fluid container depicted in a stowed state, in accordance with the present invention.

10 sealed fluid container
20 vessel
22 body
24 first handle

26 fluid level window
27 second handle
28 spout storage slot
30 fill nozzle storage slot
40 spout assembly
42 spout
43 first lifting feature
44 spout pivot enclosure
46 spout aperture
48 spout pivot seal
60 spout valve
62 spout pivot enclosure receiver
64 first gasket
66 second gasket
68 first valve aperture
80 fill nozzle assembly
82 fill nozzle
83 fill nozzle aperture
84 fill nozzle opening
85 second lifting feature
86 nozzle pivot enclosure
88 nozzle pivot seal
90 diverter feature
100 fill nozzle valve
102 nozzle pivot enclosure receiver
108 second valve aperture
120 vent/lock assembly
122 third handle
124 housing
126 shaft
127 locking pin
128 pin slot
130 spring
132 vent port
134 housing aperture
150 fluid

DETAILED DESCRIPTION OF THE PREFERRED EMBODIMENT

In accordance with the invention, the best mode is presented in terms of the described embodiments, herein depicted within FIGS. 1 through 4. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 4, disclosing a sealed fluid container (herein referred to generally as a "container") 10, where like reference numerals represent similar or like parts. The container 10 provides usage enhancements over conventional fuel storage and dispensing containers. The container 10 provides for the storage and dispensing of fluids 150, such as gasoline, kerosene, and the like. The container 10 generally includes a sealed and pivoting spout assembly 40, a fill nozzle assembly 80, and a locking assembly 120.

Figure 2A:
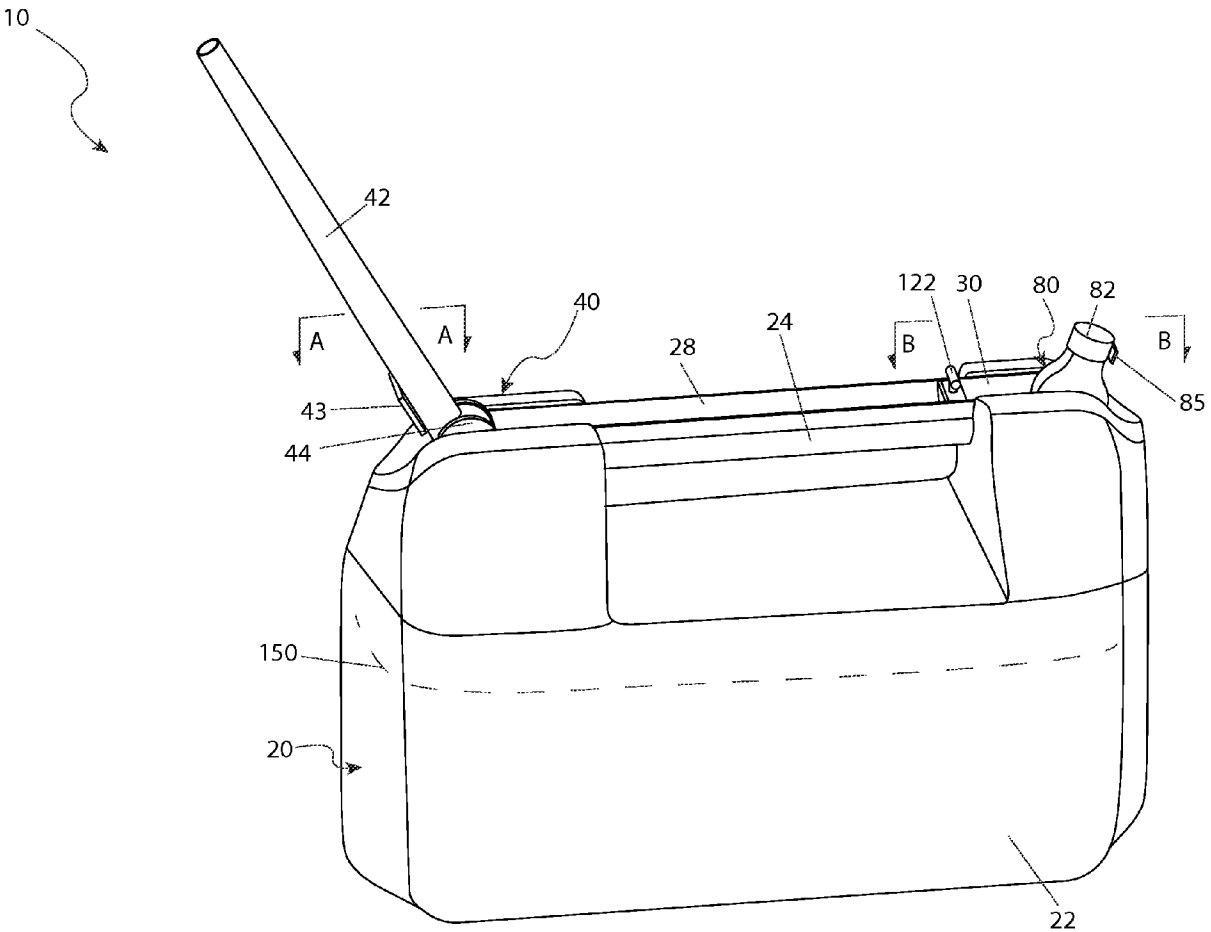
FIG. 2*a* is side perspective view of the sealed fluid container depicted in a deployed state.
Figure 2B:
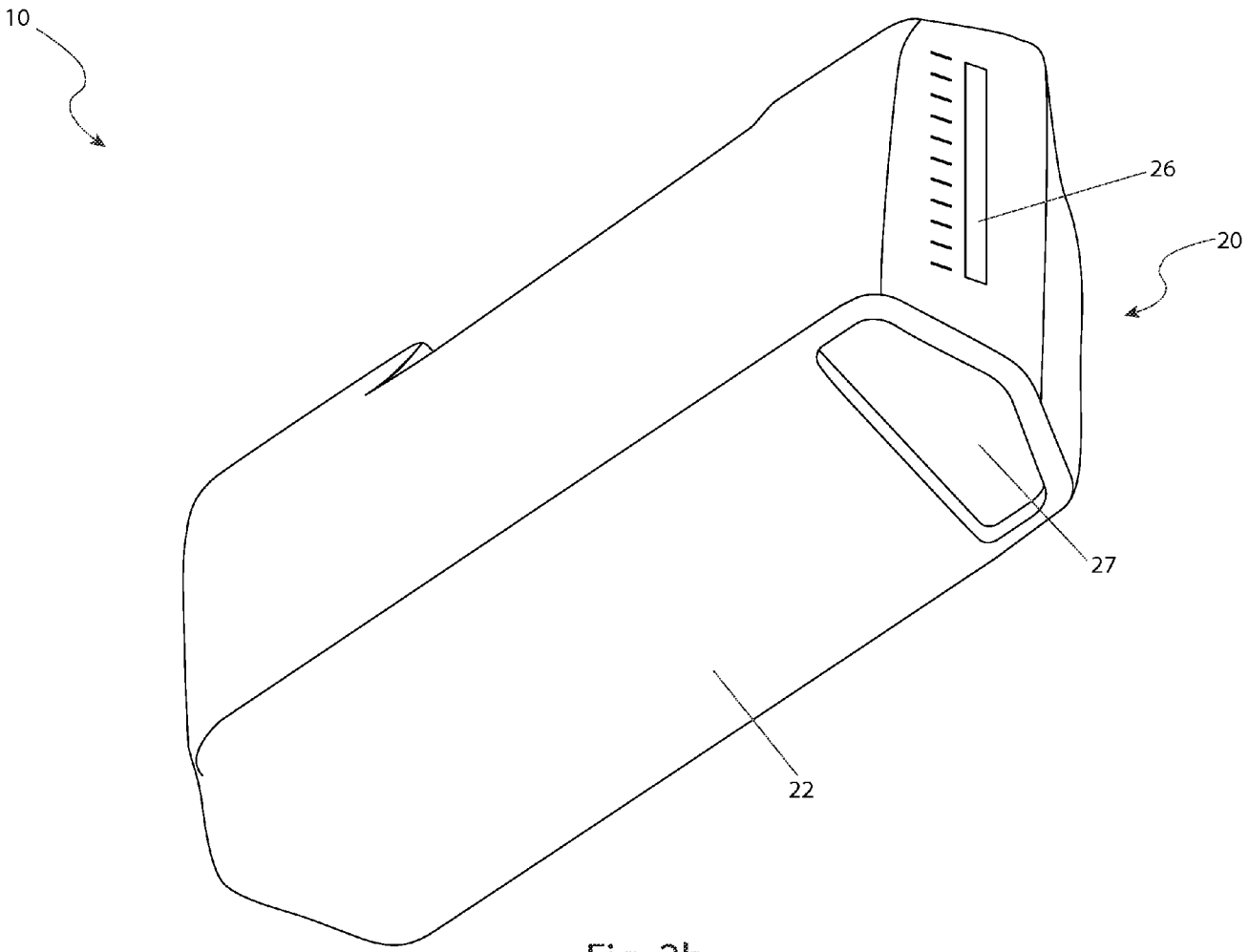
FIG. 2*b* is a bottom perspective view of the sealed fluid container.

Referring to FIGS. 1, 2*a*, and 2*b*, the container 10 can include a molded plastic fluid storage vessel 20. The vessel 20 includes a generally rectangular body 22, a first handle 24, a second handle 27, a fluid level window 26 disposed along a rear side surface, a spout storage slot 28, a fill nozzle storage slot 30, a spout valve 60, and a fill nozzle valve 100.

It can be appreciated by one skilled in the art that the teachings of the present disclosure may be incorporated to provide various fluid capacities such as one (1) gallon (1 gal), two gallons (2 gal), five gallons (5 gal), and the like, and as such should not be interpreted as a limiting factor. Furthermore, it is envisioned that the container 10 can be introduced being molded in various colors of plastic based upon a user's preference as well as to indicate particular contained fluids such as red for gasoline, blue for kerosene, and so forth.

When in a stowed state, the container 10 provides a means to securely lock the spout assembly 40 and fill nozzle assembly 80 within slot features disposed at a center top area of the container 10. The spout assembly 40 and fill nozzle assembly 80 can be recessed within respective concave spout storage slot 28 and fill nozzle slot 30, which are molded into a top surface of the vessel 20. Once in the stowed state, the spout assembly 40 and fill nozzle assembly 80 are positioned in an "end-to-end" arrangement and jointly secured by a single quarter-turn third handle 122 that also acts as a vent during filling and dispensing of a contained fluid 150. The spout assembly 40 and fill nozzle assembly 80 include pivoting and sealing features to prevent accidental spilling of fluids 150.

The vessel 20 also provides a second handle 27 (FIG. 2*b*) having a molded-in recessed area positioned along a rear bottom surface of the body 22. During pouring of the fluid 150, a user can insert their fingers into the second handle 27 to lift and tilt the container 10 forward.

Figure 3:
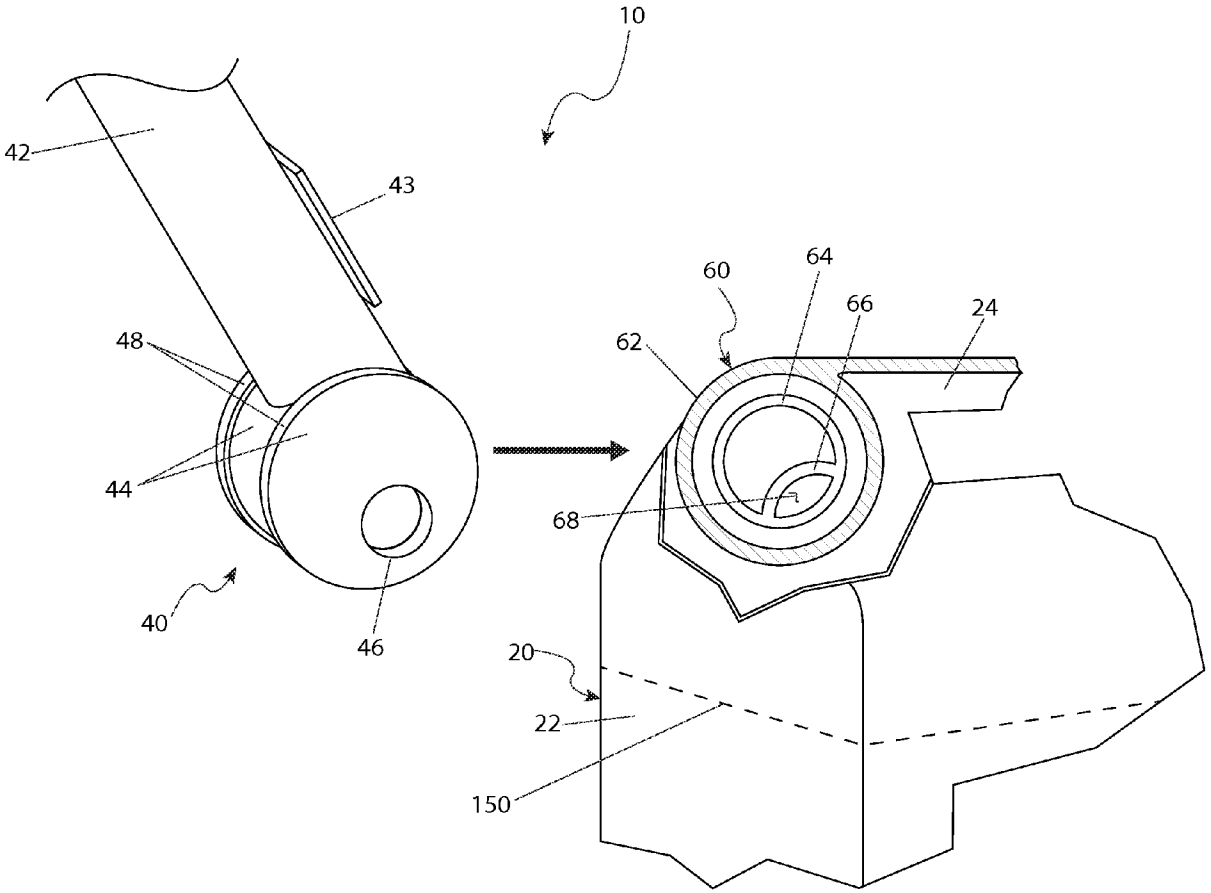
FIG. 3 is an exploded view of a spout assembly of the sealed fluid container and a section view of the sealed fluid container taken along section line A-A of FIG. 2*a*; and, FIG. 4 is an exploded section view of a fill nozzle assembly of the sealed fluid container and a section view of the sealed fluid container taken along section line B-B of FIG. 2*a*.

Referring now to FIG. 3, the spout assembly 40 provides a means of sealed pivoting deployment via pivoting engagement with a spout valve 60. The spout valve 60 can be incorporated into a top forward portion of the vessel 20. The spout assembly 40 and spout valve 60 include respective matching cylindrical portions which enable sealed dispensing of a fluid 150 only when the spout assembly 40 is in a forwardly deployed state (FIG. 2*a*).

The spout assembly 40 includes a tapering tubular spout 42 having an integral first lifting feature 43 positioned along a top surface and protruding horizontally outward on either side allowing a user to lift and deploy the spout assembly 40. The spout assembly 40 includes a cylindrical spout pivot enclosure 44 at a bottom end that protrudes perpendicularly in both directions forming a "T"-shaped hollow structure having circular spout pivot seals 48 molded-in or adhesively bonded to opposing vertical outer edges.

The spout pivot seals 48 in turn slidably engage respective and correspondingly sized opposing spout pivot enclosure receivers 62 integrated into the molded plastic vessel 20 (only one side shown). The spout pivot enclosure 44 includes a spout aperture 46 on each vertical outer side surface positioned in an offset manner. In a corresponding offset manner, the spout valve 60 includes a first valve aperture 68 which can be aligned with the spout aperture 46, when the spout 42 is rotated to a deployed position, to provide fluid communication from the vessel 20 into the spout 42. The spout valve 60 and first valve aperture 68 are arranged to be aligned only when the spout 42 is fully deployed. Therefore, when in a stored or partially deployed state, the spout valve 60 prevents the flow of the fluid 150 from the vessel 20. Each side of the cylindrical spout pivot enclosure receiver 62 provides a seal to the spout pivot enclosure 44 via a first gasket 64 and a second gasket 66 to prevent fluid leakage during dispensing.

When the spout assembly 40 is folded downwardly into the spout storage slot 28, the spout valve 60 is closed off. When the spout 42 is lifted up for pouring, the spout apertures 46 are automatically aligned with the corresponding first valve apertures 68, thereby allowing a flow of fluid 150 through both first valve apertures 68 and into the spout 42. Opening and closing of the spout valve 60 simply involves lifting and lowering of the spout 42 without touching any fluid 150 covered surfaces.

Figure 4:
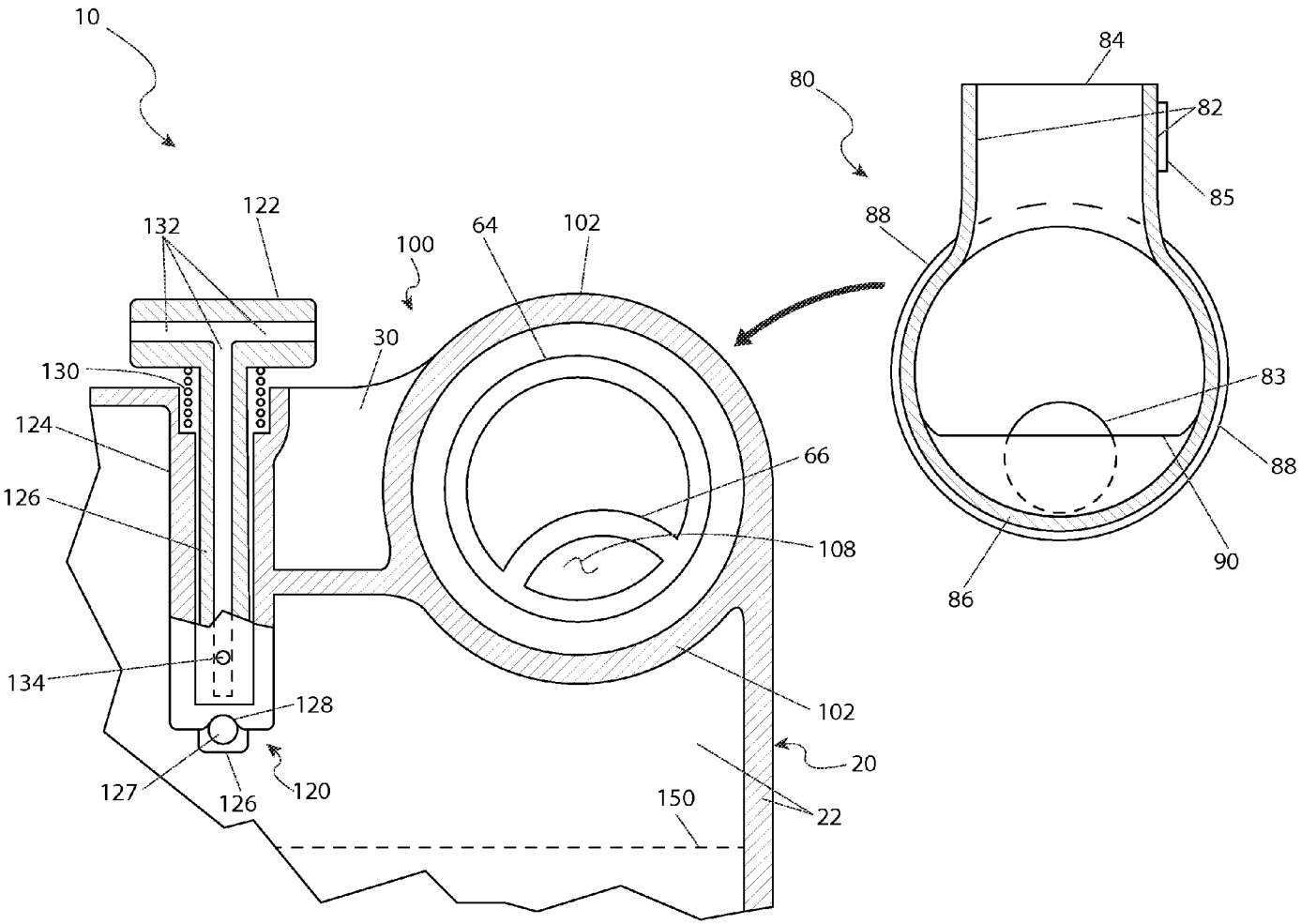

Referring now to FIG. 4, the container 10 also provides a means to fill the vessel 20 with fluid 150 using a conventional gas pump nozzle or similar means via the fill nozzle assembly 80. The fill nozzle assembly 80 utilizes a similar method of sealing and conveying the fluid 150 as the previously described spout assembly 40. The fill nozzle assembly 80 rotatably engages a fill nozzle valve 100 (only one (1) side shown), having respective interconnecting cylindrical portions including a nozzle pivot enclosure 86 and a nozzle pivot enclosure receiver 102.

The nozzle pivot enclosure 86 and nozzle pivot enclosure receiver 102 in turn include respective offset fill nozzle apertures 83 and second valve apertures 108, thereby enabling the flow of fluids 150 into the vessel 20 only when the fill nozzle 82 is deployed vertically during alignment of the fill nozzle apertures 83 and the second valve apertures 108. The nozzle pivot enclosure 86 of the fill nozzle assembly 80 includes opposing nozzle pivot seals 88 in a similar manner as the aforementioned spout pivot seals 48 of the spout assembly 40. Furthermore, the nozzle pivot enclosure receiver 102 includes first 64 and second 66 gaskets in a similar manner as the spout assembly 40. When the fill nozzle 82 is in a lowered and stowed state, the misalignment of the fill nozzle apertures 83 and second valve apertures 108 prevents any fluid 150 from leaking from the vessel 20.

The nozzle pivot enclosure 86 of the fill nozzle assembly 80 includes a molded-in diverter feature 90 located immediately below the fill nozzle aperture 83 of the fill nozzle 82. The diverter feature 90 includes opposing integral inclined surfaces along a bottom surface designed to deflect entering fluid 150 in a sideways direction to avoid possible splashing during filling of the container 10.

The container 10 includes a vent/lock assembly 120 located adjacent to the fill nozzle assembly 80 which provides child-proof locking of the spout assembly 40 and the fill nozzle assembly 80 in their respective stowed positions, as well as providing for a no-leak air venting.

The vent/lock assembly 120 includes a "push down-and-turn" mechanism retained within a hollow cylindrical housing 124 integrally-molded into a top surface of the vessel 20. The vent/lock assembly 120 includes a "T"-shaped third handle 122, which when in a locked state contacts and entraps top end portions of the spout assembly 40 and fill nozzle assembly 80, thereby preventing lifting of the assemblies 40, 80.

The third handle 122 includes an integral downwardly extending shaft 126 that occupies the hollow center of the housing 124. A bottom end of the shaft 126 extends outwardly from a bottom portion of the housing 124 where it includes a locking pin 127. The third handle 122 and shaft 126 are retained within the housing 124 via the locking pin 127 that extends and protrudes perpendicularly through the bottom end of the shaft 126. The locking pin 127 is nested, in a non-rotating manner, within pin slots 128 formed within a bottom surface of the housing 124 at opposing locations.

The housing 124 includes an internal spring 130 which acts to push upwardly upon a bottom surface of the third handle 122, thereby holding the locking pin 127 within the pin slots 128 in a spring-loaded manner. To enable rotation of the third handle 122 and shaft 126, a user pushes downwardly upon the third handle 122, thereby compressing the spring 130 and causing the locking pin 127 to separate from the pin slots 128. The user may then rotate the third handle 122 ninety degrees (90°) to enable releasing and lifting of the spout assembly 40 and fill nozzle 80 as needed.

The vent/lock assembly 120 also provides air ventilation within the vessel 20 during dispensing and filling via a vent port 132 formed within the third handle 122 and shaft 126. When the third handle 122 and shaft 126 are in their rotated and unlocked position, the vent port 132 becomes aligned with a correspondingly positioned housing aperture 134 formed within a side surface of the housing 124, thereby providing an air conduit from an internal volume of the vessel 20 through the shaft 126 and third handle 122 to maintain equal air pressure within the vessel 20 during dispensing and filling. When the third handle 122 and shaft 126 are in the locked position, the vent port 132 is sealed, thereby preventing accidental leakage of the fluid 150.

It is envisioned that other styles and configurations of the disclosed container 10 can be easily incorporated into the teachings of the present disclosure, and only certain particular configurations have been shown and described for purposes of clarity and disclosure and not by way of limitation of scope.

The user can utilize the disclosed container 10 in a simple and effortless manner with little or no training. After initial purchase or acquisition of the container 10, it can be utilized as indicated in FIGS. 1-4.

The method of utilizing the container 10 may be achieved by performing the following steps: procuring a model of the container 10 having a desired fluid volume and plastic color; unlocking the fill nozzle assembly 80 by pushing down and rotating the third handle 122 ninety degrees (90°); grasping the second lifting feature of the fill nozzle 82; lifting the fill nozzle 82 from the fill nozzle storage slot 30 by rotating the fill nozzle assembly 80 within the fill nozzle valve 100 until the fill nozzle is at a vertical orientation; dispensing a desired volume of a fluid 150 into the fill nozzle 82 in a conventional manner using a gas pump nozzle or other fluid delivery; observing the fluid level window 26 during filling to obtain a desired volume of fluid 150 within the container 10; rotating the fill nozzle 82 downwardly to its stowed position within the fill nozzle storage slot 30; rotating the third handle 122 ninety degrees (90°) to its locked position; transporting the container 10 to a desired location; dispensing the fluid 150 by pushing down and turning the third handle 122 ninety degrees (90°); grasping the first lifting feature 43 of the spout 42; lifting the spout 42 from the spout storage slot 28 by rotating the spout assembly 40 within the spout valve 60 until the spout 42 is fully deployed; grasping the first handle 24 in one hand and inserting fingers of the remaining hand into the second handle 27; lifting and tilting the container 10 to dispense a desired volume of fluid 150 from the spout 42 into a vehicle gas tank, another container, or the like; observing the fluid level window 26 periodically during dispensing until a desired amount of fluid 150 has been transferred; returning the spout 42 to the spout storage slot 28; locking the spout 42 in its stowed position by rotating the third handle 122 ninety degrees (90°) to its locked position; and, benefiting from minimized contact with fluids 150 and spill-proof operation afforded a user of the disclosed container 10.

The foregoing embodiments of the disclosed sealed fluid container have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the disclosed baluster bracket assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A sealed fluid container comprising:

a closed vessel defining an internal volume;

a spout assembly pivotably connected to said vessel and in fluid communication with said internal volume;

a fill nozzle assembly pivotably connected to said vessel and in fluid communication with said internal volume; and, a locking assembly rotatably connected to said vessel and in fluid communication with said internal volume;

wherein said spout assembly and said fill nozzle assembly are movable between a stowed position and a deployed position; and, wherein said locking assembly releasably secures said spout assembly and said fill nozzle assembly in said stowed position.

2. The container of claim 1, wherein said vessel comprises:

a walled rectangular body;

a spout storage slot disposed on an upper end of said body to receive said spout assembly when in said stowed position;

a fill nozzle storage slot disposed on said upper end of said body to receive said fill nozzle assembly when in said stowed position;

a spout valve disposed in said body for pivotable attachment of the spout assembly; and, a fill nozzle valve disposed in said body for pivotably attachment of the fill nozzle assembly.

3. The container of claim 2, wherein spout assembly comprises:

a tubular spout having an open end;

a spout pivot enclosure disposed at an end of said spout opposite said open end;

a pair of spout pivot seals disposed on opposing side surfaces of said spout pivot enclosure; and, a pair of spout apertures, each of said spout apertures being disposed through a corresponding side surface of said pivot enclosure.

4. The container of claim 3, wherein said spout valve comprises:

a pair of opposing spout pivot enclosure receivers configured to receive said spout pivot enclosure; and, a pair of valve apertures, each valve aperture being disposed within a corresponding spout pivot enclosure receiver;

wherein said spout apertures align with said valve apertures when said spout assembly is in said deployed position.

5. The container of claim 4, wherein said spout valve further comprises a pair of first gaskets for contact with said spout pivot seals, each first gasket being positioned around a corresponding spout pivot enclosure receiver.

6. The container of claim 5, wherein said spout valve further comprises a pair of second gaskets, each second gasket being positioned around a corresponding valve aperture.

7. The container of claim 3, wherein said spout storage slot comprises a recessed area of a top surface of said body suitably sized to receive said spout.

8. The container of claim 3, wherein said spout assembly further comprises a lifting feature positioned along a surface of said spout and extending outwardly.

9. The container of claim 2, wherein fill nozzle assembly comprises:

a tubular fill nozzle having an open end;

a nozzle pivot enclosure disposed at an end of said fill nozzle opposite said open end;

a pair of nozzle pivot seals disposed on opposing side surfaces of said nozzle pivot enclosure; and, a pair of fill nozzle apertures, each fill nozzle aperture being disposed through a corresponding side surface of said nozzle pivot enclosure.

10. The container of claim 9, wherein said fill nozzle valve comprises:

a pair of opposing nozzle pivot enclosure receivers configured to receive said nozzle pivot enclosure; and, a pair of valve apertures, each valve aperture being disposed within a corresponding nozzle pivot enclosure receiver;

wherein said fill nozzle apertures align with said valve apertures when said fill nozzle assembly is in said deployed position.

11. The container of claim 10, wherein said fill nozzle valve further comprises a pair of first gaskets for contact with said nozzle pivot seals, each first gasket being positioned around a corresponding nozzle pivot enclosure receiver.

12. The container of claim 11, wherein said fill nozzle valve further comprises a pair of second gaskets, each second gasket being positioned around a corresponding valve aperture.

13. The container of claim 9, wherein said fill nozzle slot comprises a recessed area of a top surface of said body suitably sized to receive said fill nozzle.

14. The container of claim 2, wherein said spout storage slot and said fill nozzle storage slot are positioned in an end-to-end configuration on a top surface of said body.

15. The container of claim 2, wherein said vessel comprises:

a first handle disposed on said upper end of said body;

a second handle disposed on a lower end of said body; and, a fluid level window disposed on a side of said body.

16. The container of claim 2, wherein said locking assembly comprises:

a T-shaped handle and a shaft extending into a hollow housing disposed within a top surface of said body, said shaft being rotatable with said housing between locked and unlocked position and linearly movable within said housing between an engaged and released position;

a locking pin extending outwardly from an end of said shaft opposite said handle, said locking pin is aligned with a pin slot disposed in said housing when said shaft is rotated to said unlocked position to move said shaft into said released position and said locking pin is misaligned with said pin slot when said shaft is rotated to said locked position once said shaft is moved into said engaged position; and, a vent port extending entirely through said shaft and said handle;

wherein when said spout assembly and said fill nozzle assembly are in said stowed position, said handle securely engages said spout assembly and said fill nozzle assembly when in said locked position.

17. A sealed fluid container comprising:

a closed vessel comprising:

a walled rectangular body defining an internal volume;

a spout storage slot disposed on an upper end of said body;

a fill nozzle storage slot disposed on said upper end of said body;

a spout valve disposed in said body, said spout valve comprising a pair of opposing spout pivot enclosure receivers and a pair of spout valve apertures, each spout valve aperture being disposed within a corresponding spout pivot enclosure receiver; and, a fill nozzle valve disposed in said body, said fill nozzle comprising a pair of opposing nozzle pivot enclosure receivers and a pair of nozzle valve apertures, each nozzle valve aperture being disposed within a corresponding nozzle pivot enclosure receiver;

a spout assembly movable between a stowed position within said spout storage slot and a deployed position and in fluid communication with said internal volume, said spout assembly comprising:

a tubular spout having an open end;

a spout pivot enclosure disposed at an end of said spout opposite said open end and being pivotably received between said pair of spout pivot enclosure receivers;

a pair of spout pivot seals disposed on opposing side surfaces of said spout pivot enclosure; and, a pair of spout apertures, each of said spout apertures being disposed through a corresponding side surface of said pivot enclosure and being alignable with said spout valve apertures when said spout assembly is in said deployed position;

a fill nozzle assembly movable between a stowed position within said fill nozzle storage slot and a deployed position and in fluid communication with said internal volume, said fill nozzle assembly comprising:

a tubular fill nozzle having an open end;

a nozzle pivot enclosure disposed at an end of said fill nozzle opposite said open end and being pivotably received between said pair of nozzle pivot enclosure receivers;

a pair of nozzle pivot seals disposed on opposing side surfaces of said nozzle pivot enclosure; and, a pair of fill nozzle apertures, each fill nozzle aperture being disposed through a corresponding side surface of said nozzle pivot enclosure and being alignable with said nozzle valve apertures when said fill nozzle assembly is in said deployed position; and, a locking assembly rotatably connected to said vessel and in fluid communication with said internal volume, said locking assembly releasably secures said spout assembly and said fill nozzle assembly in said stowed position.

18. The container of claim 17, wherein said spout storage slot comprises a recessed area of a top surface of said body suitably sized to receive said spout;

wherein said fill nozzle slot comprises a recessed area of a top surface of said body suitably sized to receive said fill nozzle; and, wherein said spout storage slot and said fill nozzle storage slot are positioned in an end-to-end configuration.

19. The container of claim 17, wherein said locking assembly comprises:

a T-shaped handle and a shaft extending into a hollow housing disposed within a top surface of said body, said shaft being rotatable with said housing between locked and unlocked position and linearly movable within said housing between an engaged and released position;

a locking pin extending outwardly from an end of said shaft opposite said handle, said locking pin is aligned with a pin slot disposed in said housing when said shaft is rotated to said unlocked position to move said shaft into said released position and said locking pin is misaligned with said pin slot when said shaft is rotated to said locked position once said shaft is moved into said engaged position; and, a vent port extending entirely through said shaft and said handle;

wherein when said spout assembly and said fill nozzle assembly are in said stowed position, said handle securely engages said spout assembly and said fill nozzle assembly when in said locked position.

20. The container of claim 17, wherein said spout valve further comprises a pair of first gaskets for contact with said spout pivot seals, each first gasket being positioned around a corresponding spout pivot enclosure receiver; and, wherein said fill nozzle valve further comprises a pair of first gaskets for contact with said nozzle pivot seals, each first gasket being positioned around a corresponding nozzle pivot enclosure receiver.

* * * * *